US005636694A

United States Patent [19]

Mireles, Jr. et al.

[11] Patent Number: 5,636,694

[45] Date of Patent: Jun. 10, 1997

[54] HYDRAULIC POWER STROKER FOR SHIFTING OF SLIDING SLEEVES

[75] Inventors: Hector H. Mireles, Jr., Spring; Jesse J. Constantine, Jr., Kingwood, both of Tex.

[73] Assignee: Baker Hughes Incorporated, Houston, Tex.

[21] Appl. No.: 429,919

[22] Filed: Apr. 27, 1995

[51] Int. Cl.[6] ..... E21B 19/00

[52] U.S. Cl. ..... 166/381; 166/120; 166/208

[58] Field of Search ..... 166/381, 120, 166/137, 208, 382, 55.8

[56] References Cited

U.S. PATENT DOCUMENTS

| | | | |
|---|---|---|---|
| 3,419,075 | 12/1968 | Brown . | |
| 3,603,388 | 9/1971 | Current | 166/120 |
| 3,706,342 | 12/1972 | Woolley | 166/134 |
| 4,133,342 | 1/1979 | Carnahan | 166/277 X |
| 4,531,581 | 7/1985 | Pringle et al. | 166/120 |
| 4,917,191 | 4/1990 | Hopmann et al. . | |
| 5,012,871 | 5/1991 | Pleasants et al. | 166/386 |
| 5,044,441 | 9/1991 | Rubbo et al. | 166/382 |
| 5,070,941 | 12/1991 | Kilgore . | |
| 5,090,481 | 2/1992 | Pleasants et al. . | |
| 5,156,210 | 10/1992 | Roth . | |
| 5,183,114 | 2/1993 | Mashaw, Jr. et al. . | |
| 5,211,241 | 5/1993 | Mashaw, Jr. et al. . | |
| 5,285,850 | 2/1994 | Bayh, III | 166/321 |
| 5,305,833 | 4/1994 | Collins . | |

*Primary Examiner*—Frank Tsay
*Attorney, Agent, or Firm*—Rosenblatt & Redano P.C.

[57] ABSTRACT

The invention allows downhole shifting of one or more sleeves, having the same or different dimensions, while running a running tool on coiled tubing. The power stroker feature anchors the running tool to the body of the sleeve housing for proper orientation. Hydraulic pressure is used to stroke the sleeve. A feedback feature is provided to determine from the surface whether the sleeve has fully shifted. The stroking components are resettable upon withdrawal of hydraulic pressure and an emergency shear release is also provided.

25 Claims, 13 Drawing Sheets

HYDRAULIC POWER STROKER FOR SHIFTING OF SLIDING SLEEVES

FIELD OF THE INVENTION

The field of this invention relates to auxiliary power strokers for downhole tools, particularly a shifting tool run on coiled tubing.

BACKGROUND OF THE INVENTION

In the past, sliding sleeves at various depths and orientations in the wellbore had to be shifted to permit various downhole operations. If the shifting tools were run into the wellbore on rigid tubing, it was usually not too severe a problem to apply a pushing force through the tubing. However, as wellbores became more deviated and with the advent of coiled tubing to decrease the duration of trips into and out of the well, situations arose more often where a force was required to move a sliding sleeve downwardly but could not be provided through the coiled tubing supporting the shifting tool. While, to some degree, the coiled tubing could be used to provide uphole shifting forces when placed in tension, it was more problematic to put the coiled tubing in compression and have any kind of meaningful force applied downhole where the shifting tool engaged the sleeve.

Prior designs which attempted to apply a booster force downhole in coiled tubing applications involved complex mechanisms for anchoring which had the potential for unexpected release due to failure to obtain a solid grip and the inability to provide feedback for alignment so that the surface personnel could know that the booster mechanism had anchored itself in the proper location. Additional repeated shifting using such prior designs resulted in gripping in a similar spot in the tubing with the slips which could gouge or mar the tubing wall, potentially causing downtime. Typical of such designs is U.S. Pat. No. 5,070,941. This patent has a thorough discussion of the prior art pertinent to anchoring devices and piston cylinder combinations.

The apparatus of the present invention represents an improvement over the prior designs in that it presents a simple design which not only provides feedback on whether the downhole operation has been properly accomplished but also, due to its configuration, properly positions the power stroking apparatus for a firm and reliable anchoring which can be easily set and released repeated times while downhole in a reliable manner. It also provides for a simple release because the use of dogs eliminates risk of use of slips that may be difficult to disengage.

SUMMARY OF THE INVENTION

The invention allows downhole shifting of one or more sleeves, having the same or different dimensions, while running a running tool on coiled tubing. The power stroker feature anchors the running tool to the body of the sleeve housing for proper orientation. Hydraulic pressure is used to stroke the sleeve. A feedback feature is provided to determine from the surface whether the sleeve has fully shifted. The stroking components are resettable upon withdrawal of hydraulic pressure and an emergency shear release is also provided.

DETAILED DESCRIPTION OF THE PREFERRED EMBODIMENT

Figure 1A:
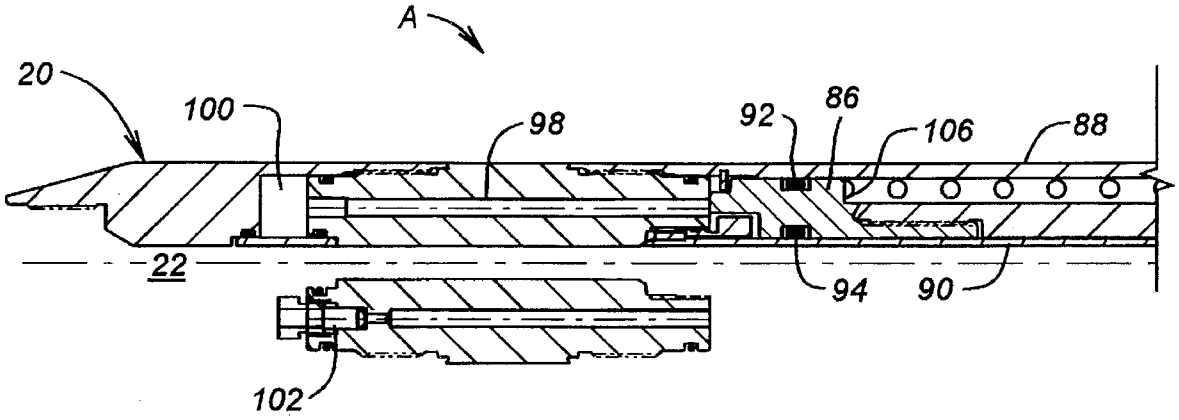
FIGS. 1(*a*)–(*f*) is a sectional view of the apparatus in the run-in position, with the sliding sleeve engaged.
Figure 1B:
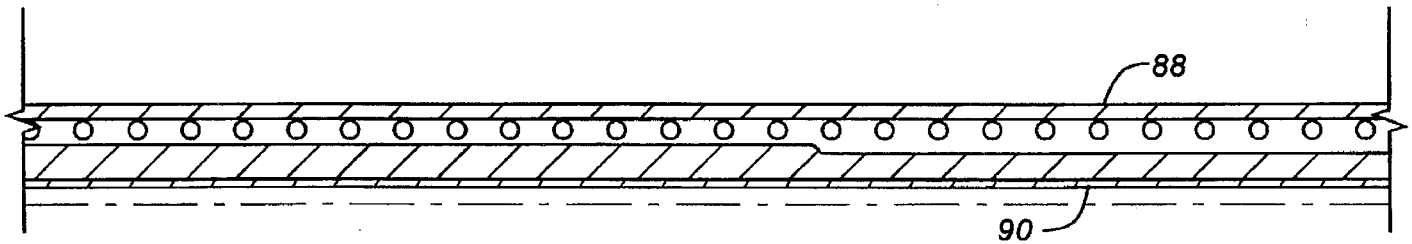
Figure 1C:
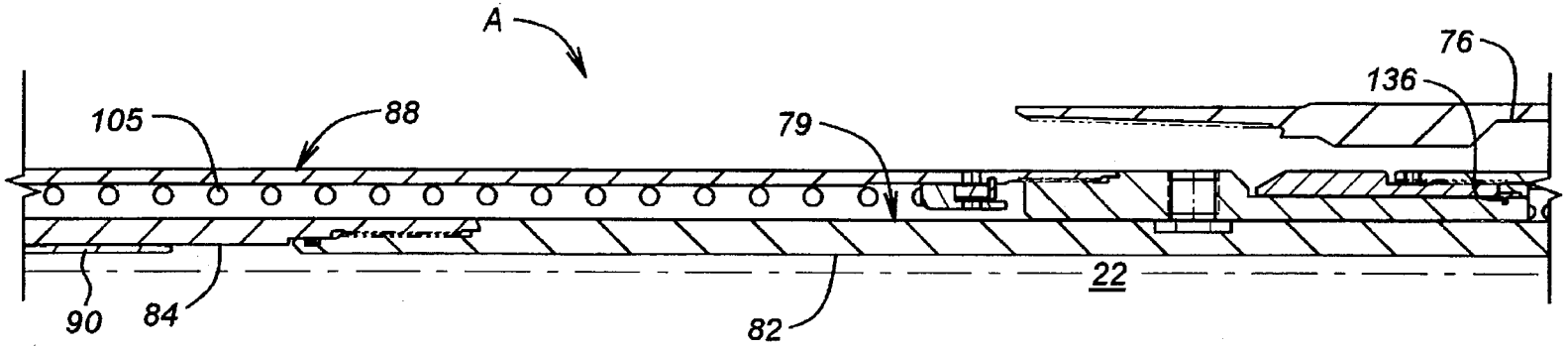
Figure 1D:
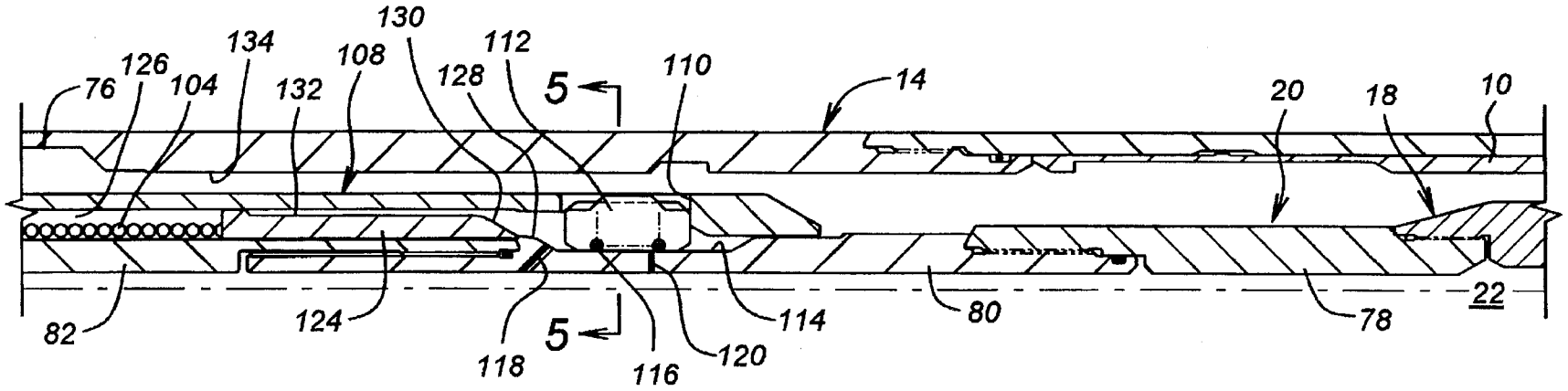
Figure 1E:
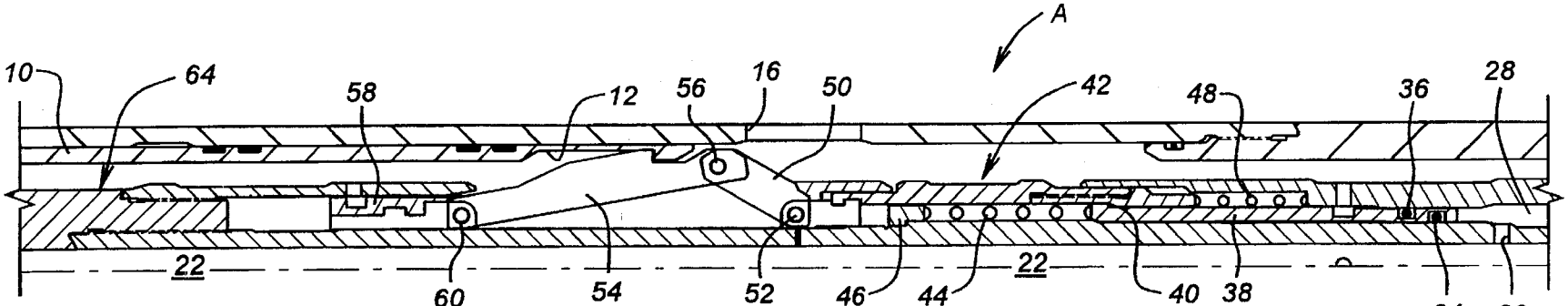
Figure 1F:
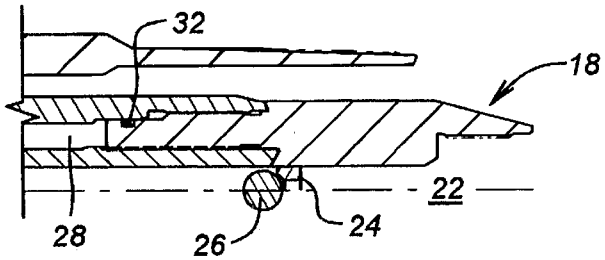
Figure 2A:
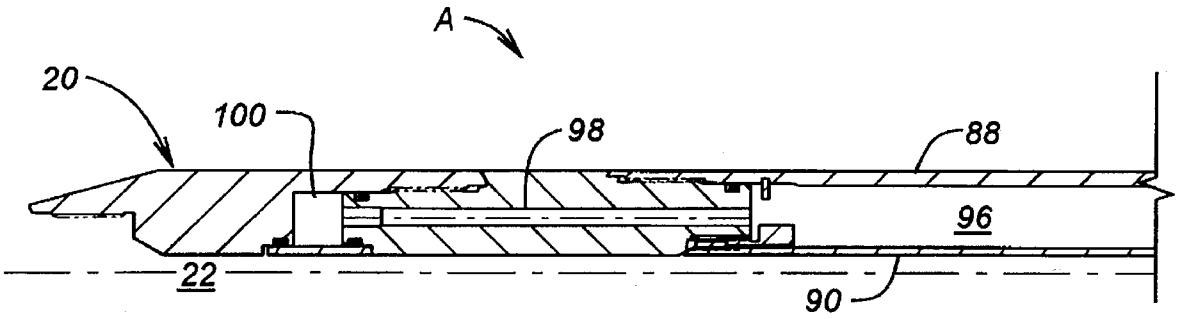
FIGS. 2(*a*)–(*f*) is the view of FIGS. 1(*a*)–(*f*), with the anchoring system engaged to the sleeve housing.
Figure 2B:
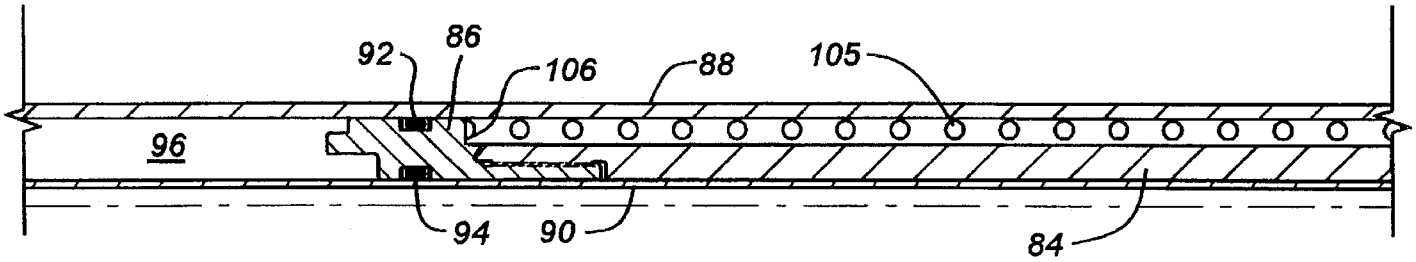
Figure 2C:
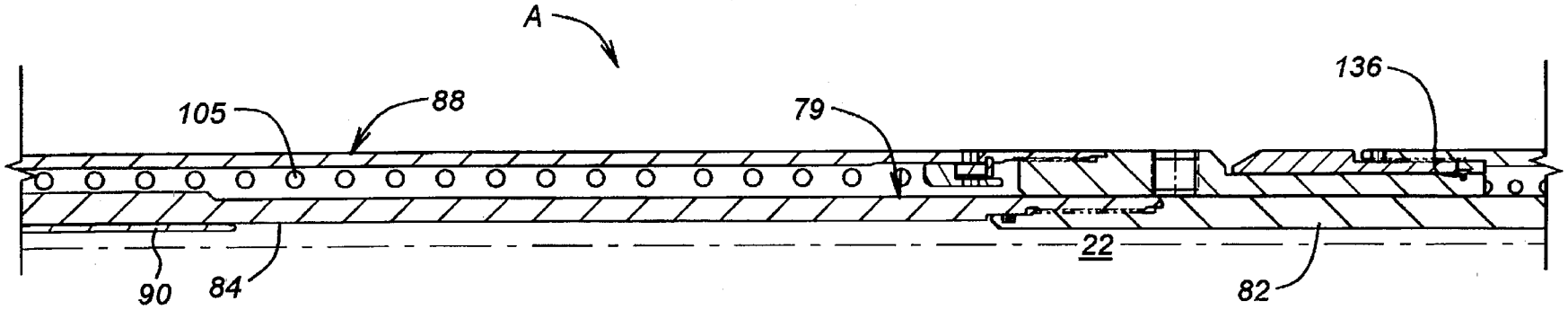
Figure 2D:
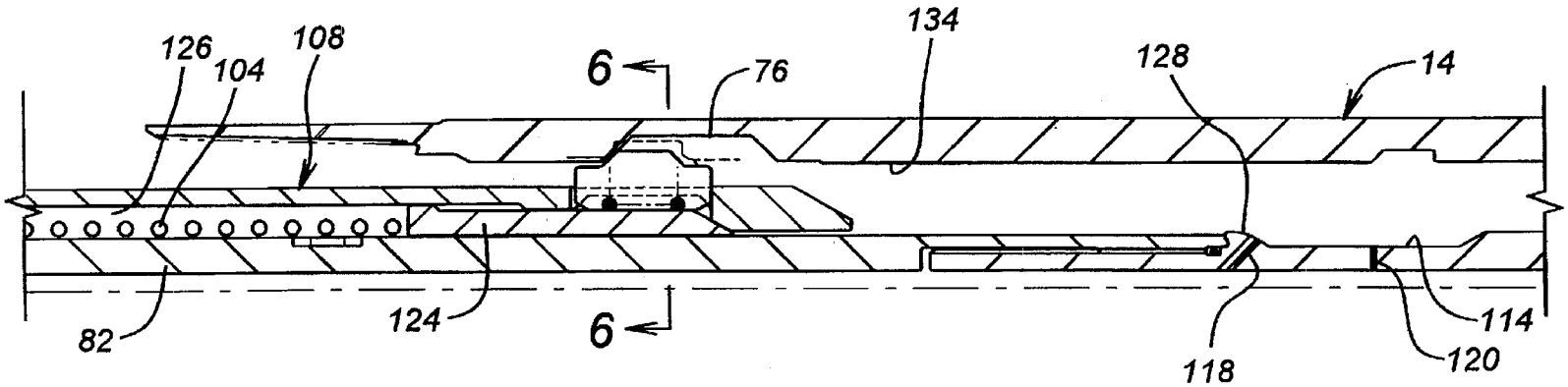
Figure 2E:
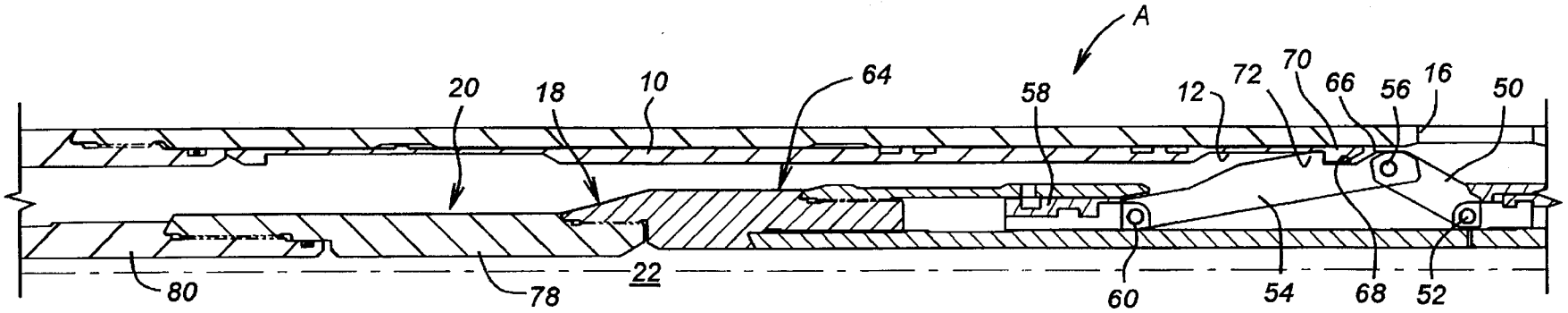
Figure 2F:
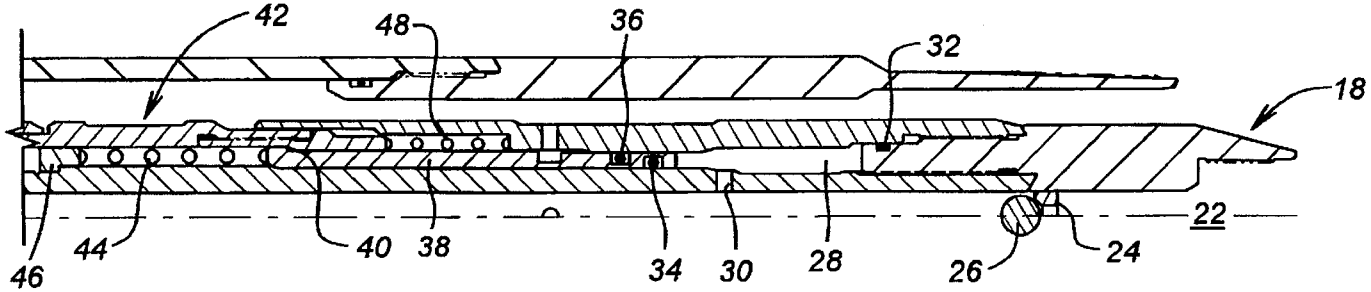
Figure 3A:
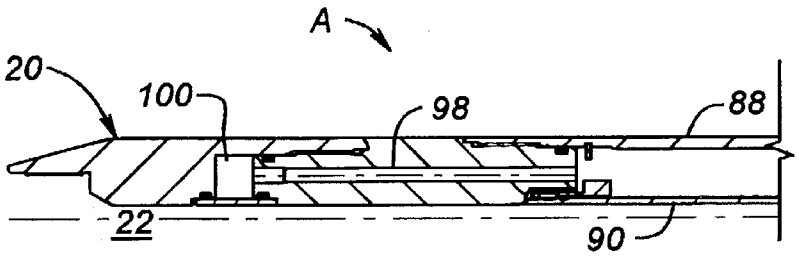
FIGS. 3(*a*)–(*f*) is the view of FIGS. 2(*a*)–(*f*), with additional hydraulic pressure applied, resulting in shifting of the sleeve and an automatic release therefrom.
Figure 3B:
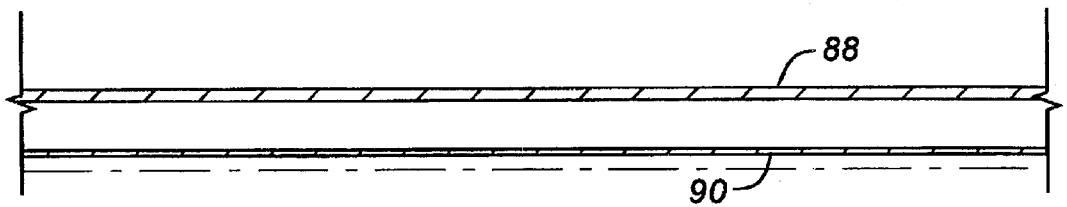
Figure 3C:
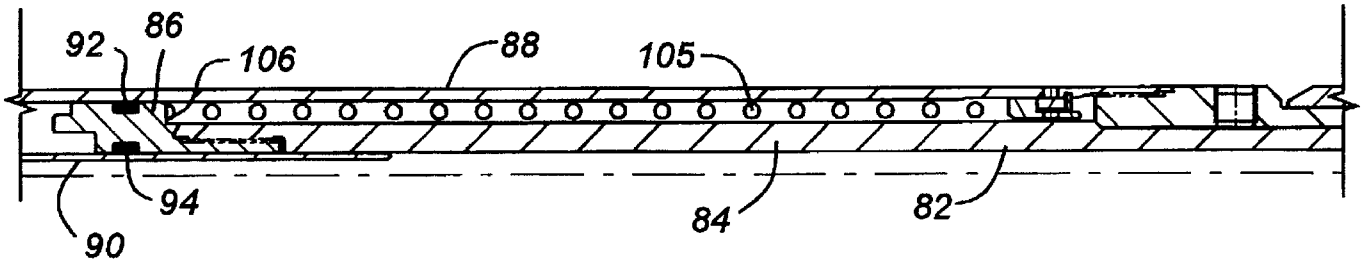
Figure 3D:
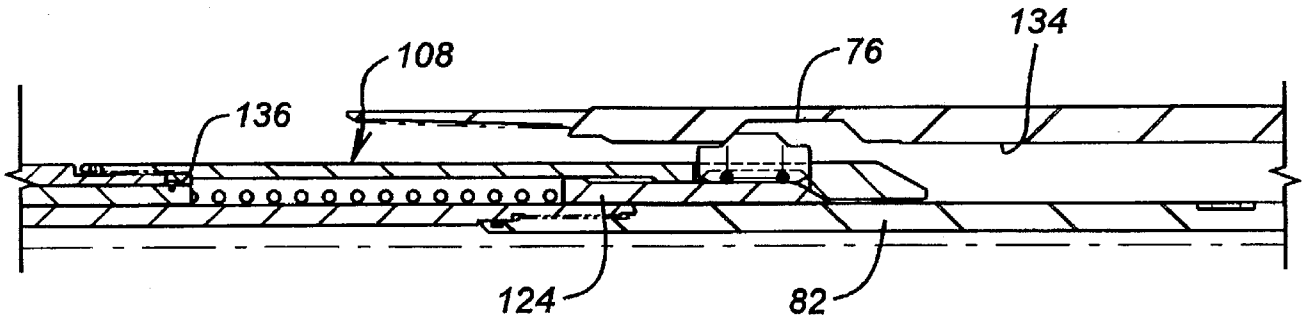
Figure 3E:
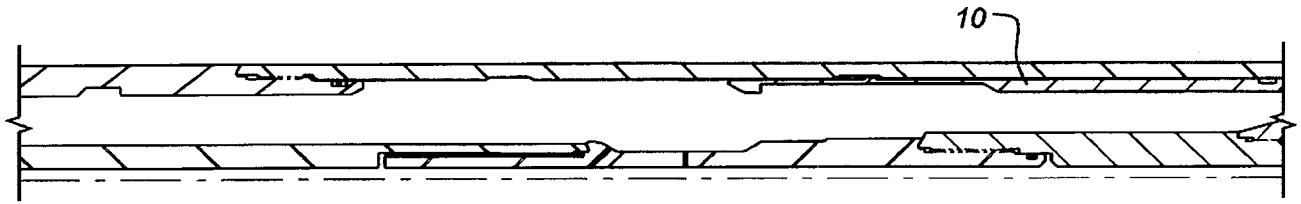
Figure 3F:
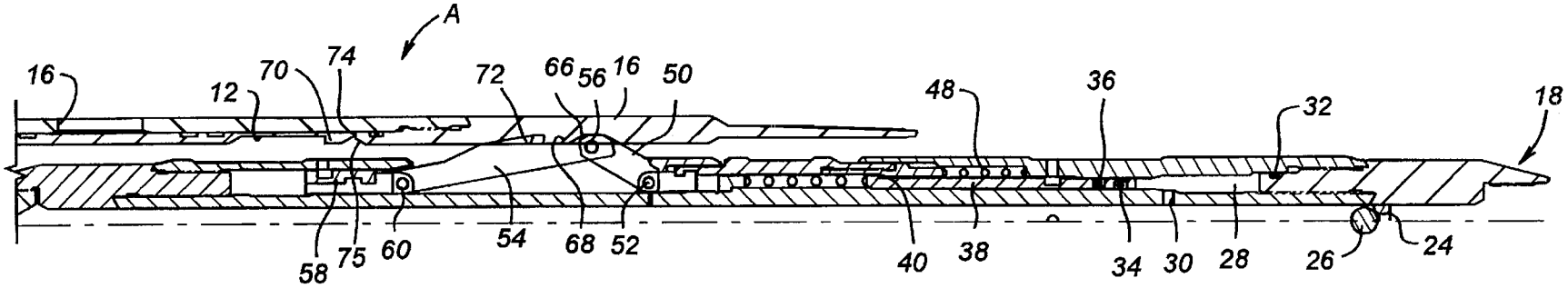
Figure 4A:
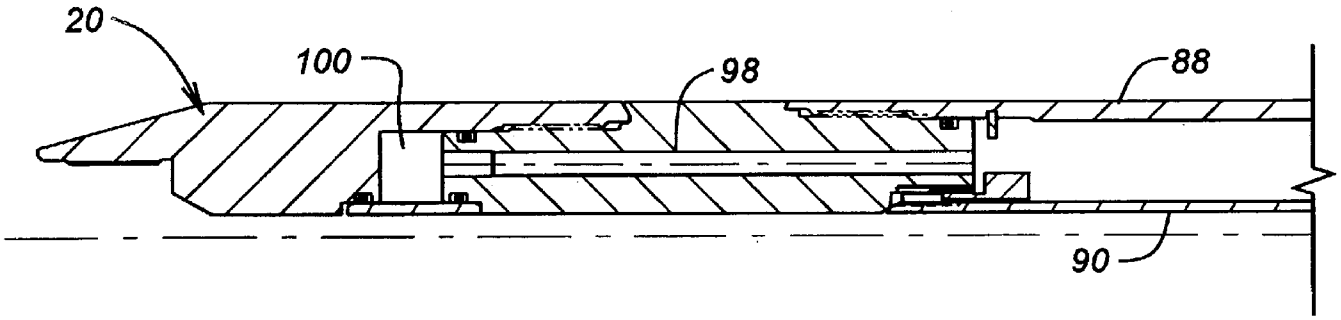
FIG. 4 is the view of FIGS. 3(*a*)–(*f*), illustrating the emergency shear release feature.
Figure 4B:
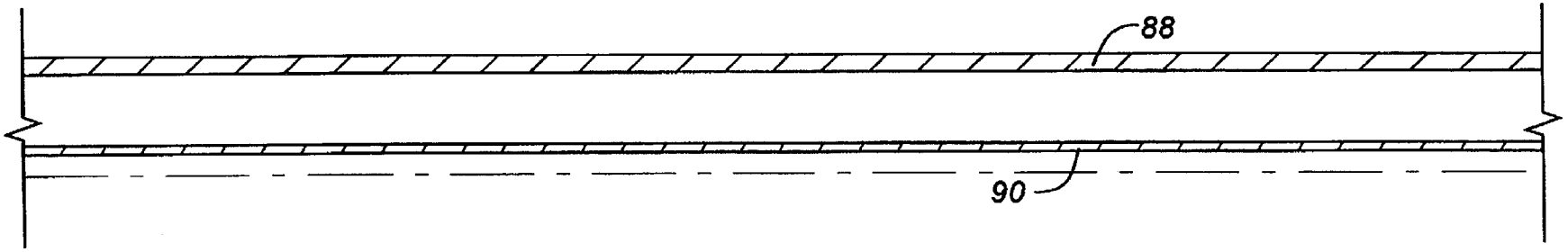
Figure 4C:
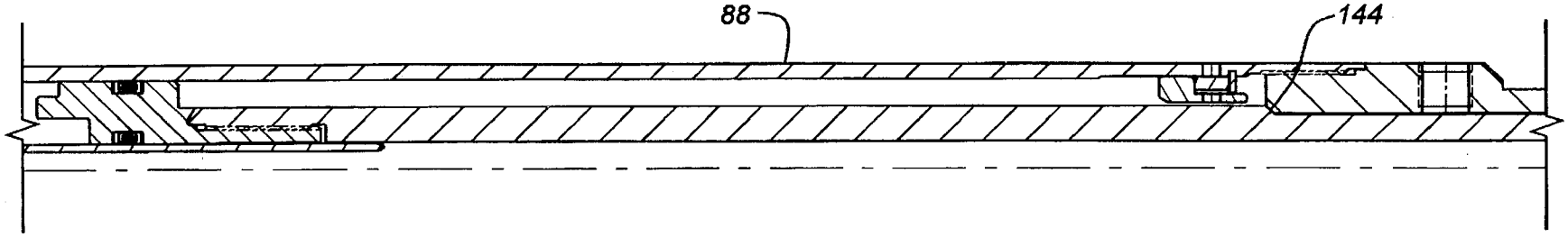
Figure 4D:
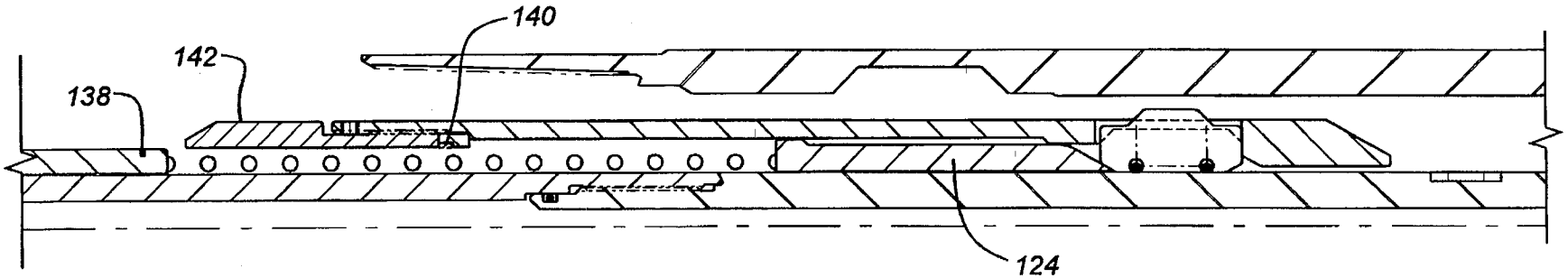

The apparatus A of the present invention is shown in FIG. 1. One of the uses of the apparatus A is to move a sleeve 10 by engaging a groove 12. In the position shown in FIG. 1(*e*), the sleeve 10 is mounted in a housing 14 which can be part of a casing assembly (not shown). The housing 14 can also be part of a tubing assembly. A lateral port 16 is uncovered with respect to the sleeve 12 in the position shown in FIG. 1(*e*). One use of the apparatus A is to move the sleeve 10 to the position shown in FIGS. 3(*e–f*), where the port 16 is covered by the sleeve 10. The apparatus A has a lower assembly 18 which begins at FIG. 1(*e*) and extends to the lower end of the apparatus A shown in FIG. 1(*f*). This section of the apparatus A includes the gripping assembly to engage the groove 12, as will be described below. The balance of the apparatus A, or upper section 20, which extends from FIG. 1(*a*) through FIG. 1(*d*), is the power piston to actuate movement of sleeve 10, as will be described below.

Lower section 18 and upper section 20 define a bore 22 therethrough. A seat 24 (see FIG. 1(*f*)) is placed in bore 22 and has a profile to catch a sphere 26 to create backpressure in bore 22. Those skilled in the art will appreciate that numerous other devices can be used to create backpressure in bore 22, such as a restriction orifice, without departing from the spirit of the invention. With bore 22 obstructed, pressure can be built up from the surface. That pressure is seen in cavity 28 through port 30. Seals 32, 34, and 36 effectively seal cavity 28. Retaining piston 38 holds seals 36 and 34. Shoulder 40 on retaining piston 38 holds back shifting piston 42. Spring 44 is supported from ring 46 and contacts retaining piston 38 to bias it in a direction toward cavity 28. However, when sufficient pressure is built up in cavity 28, the opposing force of spring 44 is overcome and retaining piston 38 shifts to the position shown in FIG. 1(*e*). Once the retaining piston 38 moves in a direction to compress spring 44, shoulder 40 moves in such a way so as to let spring 48 bias the shifting piston 42. The shifting piston 42 is connected to link 50 at pin 52. Link 50 is connected to link 54 at pin 56. Slider 58 is connected to link 54 at pin 60.

Those skilled in the art will appreciate that when there's no pressure in cavity 28, spring 44 overcomes spring 48 to keep the links 50 and 54 in a retracted position. In that retracted position (not shown), pin 56 is further away from the longitudinal axis of the apparatus A than pins 52 and 60 such that when spring 48 is allowed to move shifting piston 42, the tendency of the linkage comprising links 50 and 54 is to induce rotation of the links 50 and 54 about pin 56 while radially translating pin 56 outwardly. As a result of such motion, the link 54, which has a unique shape, rotates in a counterclockwise direction about pin 60, which, during the rotation, also translates longitudinally.

Referring to FIG. 2(*e*), link 54 has a protrusion 66 adjacent a depression 68, which is cut into link 54 such that when link 54 rotates counterclockwise, depression 68 squarely grabs protrusion 70, while a further projection 72 enters the groove 12. By configuring the shape of link 54 in the manner described, the same apparatus A can be used to engage grooves 12 on sleeves of differing diameters while still obtaining a bite on such grooves comparable to a design which features a radially movable dog projecting through a cut-out in a body, moving linearly to engage a groove 12. The projection 66 has a purpose of being a cam to push the projection 72 out of groove 12 once the sleeve 10 moves sufficiently close to its bottom travel stop 74 (see FIG. 3(*f*)). As the sleeve 10 approaches the travel stop 74, the projection 66 encounters taper 75, thus camming the projection 72 out of groove 12 and allowing the apparatus A to advance further down as shown in FIG. 3(*f*).

Those skilled in the art will appreciate that the apparatus A can be run into the wellbore to a desired location with the linkage 50 and 54 in a retracted position. This can be accomplished so long as no pressure build-up occurs in bore 22. Once the apparatus A is positioned adjacent a sleeve 10 that is of interest, the bore 22 can be obstructed or pressure built-up therein in the manner previously described to initiate the sequence previously described in order to obtain an engagement between link 54 in groove 12 as shown in FIG. 1(*e*).

Referring now to FIGS. 1(*c*) and (*d*), the housing 14 has an internal groove 76 which is positioned at a predetermined distance from groove 12 when the sleeve 10 is in the up position, as shown in FIG. 1(*e*). The upper section 20 of the apparatus A has a multi-sectioned piston 79 which comprises of sections 78, 80, 82, 84, and 86. The top-most portion of the piston 86 is slidably movable between outer sleeve 88 and inner sleeve 90. Seals 92 and 94 seal, respectively, against outer sleeve 88 and inner sleeve 90. As shown in FIG. 2(*b*), a variable-volume cavity 96 exists above section 86. To reduce wear on seals 92 and 94, a tubular filter 98 made of a sintered metal material filters any fluid which can enter cavity 96. A regulator 100 keeps pressure built-up in bore 22 from entering cavity 96 until a predetermined minimum pressure is exceeded. This allows link 54 to rotate to engage groove 12 before piston 79 is actuated. Cavity 96 also has a check valve 102 which is shown in a broken away manner in FIG. 1(*a*), although it is literally mounted adjacent the regulator 100 above cavity 96. Check valve 102 allows depressurization of cavity 96 to facilitate the return of the piston assembly 79 to the position shown in FIG. 1. Spring 105 is a return spring which, after it is compressed as shown in FIG. 2(*c*), applies a return force to shoulder 106 on section 86 of piston 79.

The outer sleeve 88 has connected to it a cage 108, which has in it a plurality of openings or windows 110. Locating dogs 112 are aligned with openings 110 and are held in a retracted position in groove 114 of segment 80, as shown in FIG. 1(*d*), by virtue of circumferential spring or springs 116. Ports 118 and 120 help to flush out any accumulated debris from groove 114 to facilitate the operation of dogs 112, as will be described below.

Cage 108 defines an annular space 126 within which wedge or cam 124 is free to translate. Spring 104 biases the wedge 124 against travel stop 128. Travel stop 128 is disposed on segment 80, as shown in FIG. 1(*d*). In the run-in position shown in FIG. 1(*d*), the circumferential spring 116 keeps the dog or dogs 112 retracted within openings 110. Wedge 124 has a taper 130 and a top surface 132 which will be used to secure the position of the dogs 112 engaged in groove 76, as shown in FIGS. 2(*c*) and (*d*), as will be described below.

The significant components of the apparatus A now having been described, the sequence of operation will be reviewed. The apparatus A is positioned in the vicinity of a groove 12 on a sleeve 10 which is to be shifted. In the preferred embodiment, the orientation of the apparatus A is to engage the groove 12 to push the sleeve 10 downhole to close off the opening 16.

As previously stated, the bore 22 is constricted or obstructed. In the preferred embodiment, a sphere 26 is dropped against a seat 24 to obstruct the bore 22. Pressure is then built up to a few hundred lbs. which is sufficient to increase the size of variable-volume cavity 28 and to urge the retaining piston 38 against the force of spring 44. This allows spring 48 to bias the shifting piston 42, which in turn actuates links 50 and 54 to turn about pin 56. This motion of the linkage 50 and 54 allows the depression 68 to present itself squarely against the protrusion 70 of the sleeve 10, while at the same time allowing projection 72 to enter groove 12. At that point, the pressure is further increased to a point above the setting of regulator 100. At this point, the piston assembly 79 cannot move down any further because the resistance to movement offered by sleeve 10 has yet to be exceeded. As a result, there is a reaction force which drives up the outer sleeve 88 and, along with it, the inner sleeve 90, as can be seen by comparing FIGS. 1(*a*)–(*c*) to FIGS. 2(*a*)–(*c*). With the upward movement of outer sleeve 88, there is a corresponding upward movement of cage 108, which is directly connected thereto. Cage 108, with dogs 112 sticking into window 110, begins to pull the dogs 112 upwardly out of groove 114 and against tapered surface 130. Further application of pressure into cavity 96 continues to urge the outer sleeve 88 upwardly, thereby forcing the dogs 112, which are being drawn radially inwardly by circumferential spring 116, to push wedge 124 upwardly, compressing spring 104. As the compression of spring 104 progresses, the dogs 112 are restricted from further outward movement by surface 134 of the housing 14. When the dogs 112 have been pulled sufficiently upwardly to align themselves with groove 76, the stored force in spring 104 overcomes the radially retractive force of circumferential springs 116, thus driving the wedge 124 under the dogs 112, forcing the dogs 112 outwardly into groove 76. When this occurs, as shown in FIGS. 2(*c*) and 2(*d*), wedge 124 is biased by spring 104 while at the same time the dogs 112 are locked into groove 76.

Thereafter, upon further increase in applied pressure from the surface into cavity 96, the piston assembly 79 begins to move downwardly because the outer sleeve 88 is, in effect, locked to the housing 14 and can move up no further. The piston assembly 79 then shifts downwardly, as can be seen by comparing FIGS. 2(*a*) and (*b*) with 3(*a*) and (*b*). Since the piston assembly 79 is connected to the lower assembly 18 and link 54 is in contact with groove 12, movement downwardly of piston assembly 79 in effect shifts sleeve 10 to the position shown in FIG. 3(*e*). As previously stated, the projection 66 ultimately contacts tapered surface 75, thus camming link 54 in a clockwise direction out of groove 12 so that the linkage comprising links 50 and 54 winds up in the position shown in FIGS. 3(*e*)–(*f*). At this time the pressure applied from the surface into bore 22 is removed, thus allowing check valve 102 to bleed pressure off of cavity 96, which in turn allows spring 105 to retract piston assembly 79, thus pulling up travel stop 128, until travel stop 128 grabs wedge 124. This results in recompression of spring 104 and liberation of dogs 112 from being captured in groove 76 as wedge 124 is forced up and out from under dogs 112. The apparatus A may be removed from the housing 14 or reattached to sleeve 10 for another pull or push or repositioned to test for completed movement of sleeve 10, as desired.

Feedback can be obtained to determine from the surface whether the sleeve 10 has shifted fully. Because of the unique shape of link 54, if the sleeve 10 has shifted fully close enough to its travel stop 74, the link 54 cannot reengage the groove 12. Accordingly, pressure can again be applied in bore 22 while the apparatus A is moved in the vicinity of groove 12. If no engagement of link 54 occurs, then the feedback to the surface is that the sleeve 10 has fully shifted. If reengagement of link 54 occurs, then the feedback is the opposite in that the sleeve 10 has not fully shifted sufficiently close to its travel stop 74.

Figure 5:
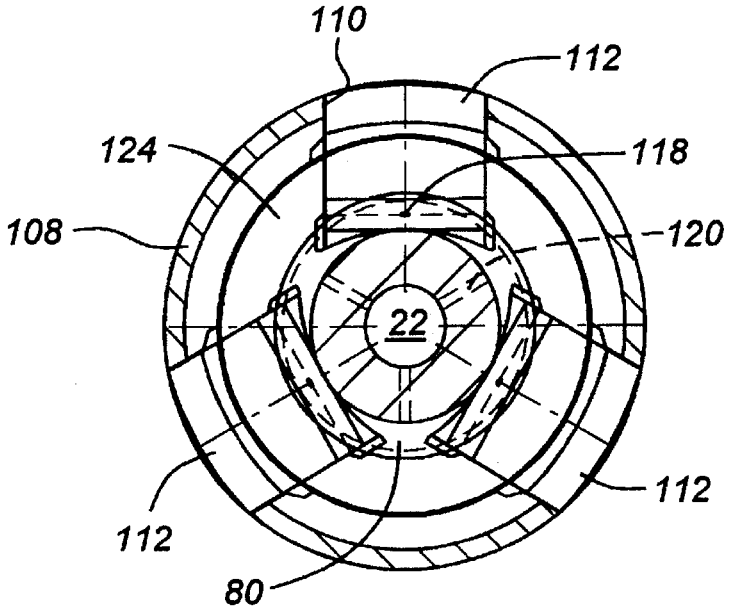
FIG. 5 is a sectional view along lines 5—5 of FIG. 1 of the locating dogs in the retracted position.
Figure 6:
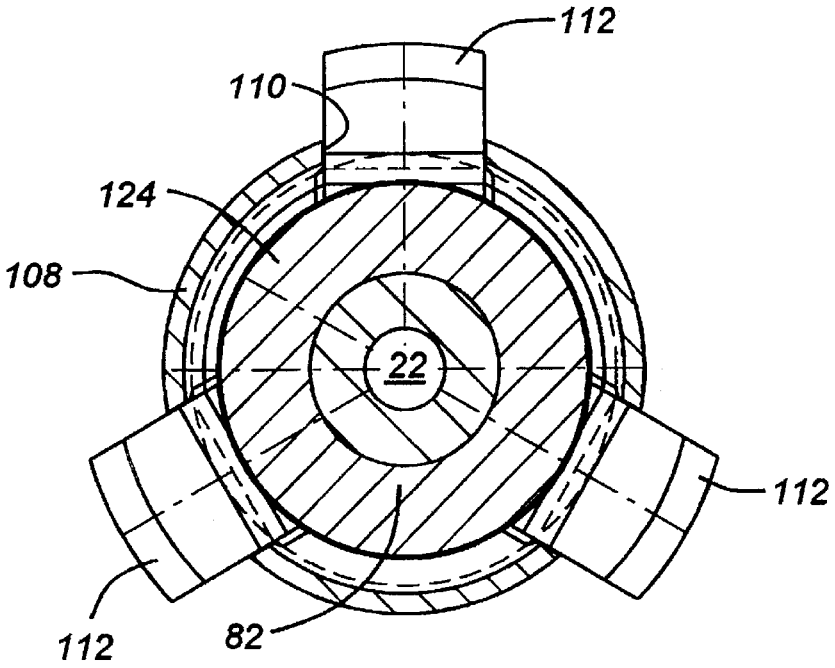
FIG. 6 is a sectional view along lines 6—6 of FIG. 2, with the locating dogs in the expanded position for anchoring the apparatus.
Figure 7A:
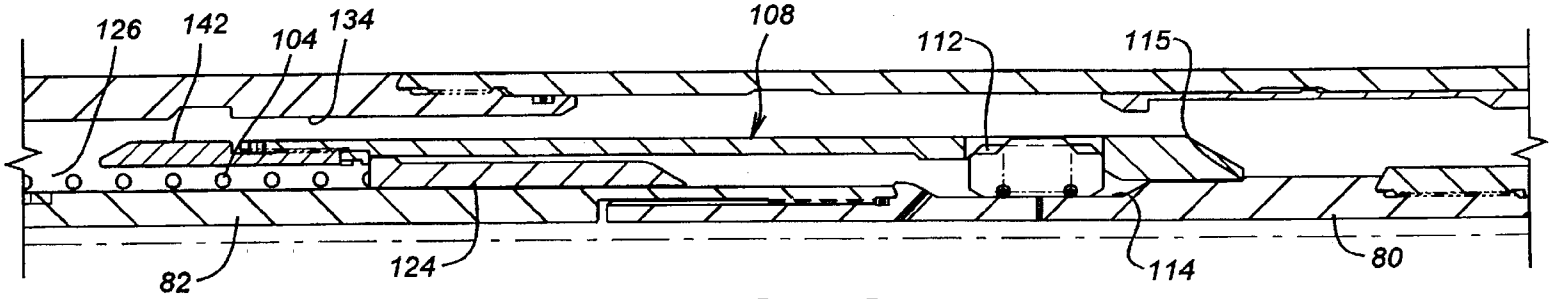
FIG. 7 is the view of FIG. 4 in the emergency release position, with the locking dogs fully retracted to facilitate removal of the apparatus.
Figure 7B:
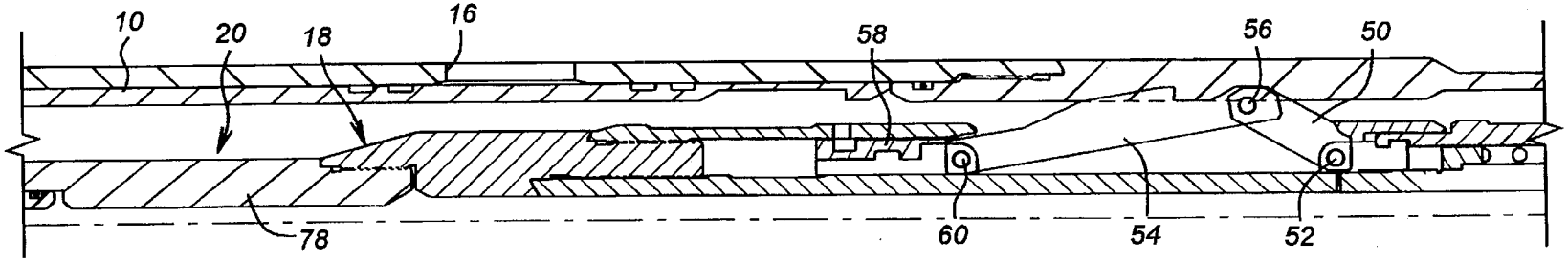
Figure 7C:
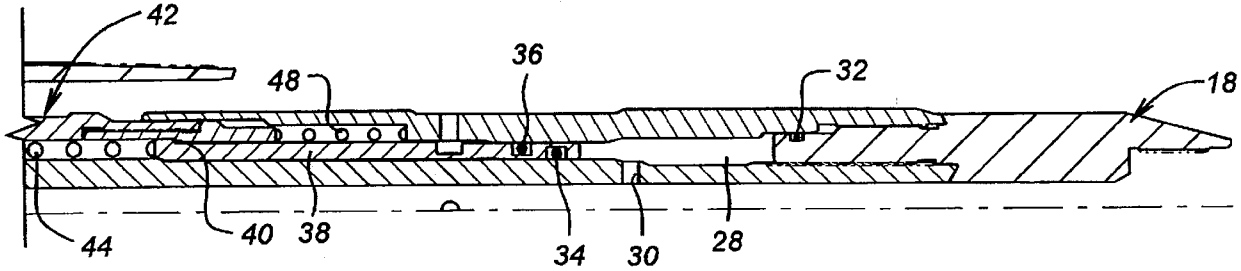

An emergency release is also possible and is shown in FIGS. 4(*a*)–(*d*). A T-shaped shear ring 136 (see FIG. 1(*c*)) connects cage 108 to outer sleeve 88. If, for any reason, the apparatus A becomes stuck, the assembly which includes the inner sleeve 80 and outer sleeve 88 can be removed from the wellbore with the coiled tubing to which it is attached (not shown) by shearing shear ring 136 (see FIG. 1(*c*) to see shear ring 136 in the unbroken position). This position is shown in FIG. 4(*c*). The T-shaped shear ring 136, although not shown in FIG. 4(*c*), previously occupied grooves 138 and 140. After the shear release, the entire assembly, beginning at ring 142, drops down until the dogs 112 reengage groove 114, as shown in FIG. 5. The assembly beginning at ring 142 has its lower travel limit defined by stop 115 on segment 80. In essence, FIG. 4(*c*) illustrates the onset of a shear release, while FIG. 5 shows the assembly from ring 142 down being supported by dogs 112 in groove 114. The shear release just described allows the wedge 124 to become undermined by relaxing spring 104 (and, if required, by pushing up wedge 124 with stop 128) if it will not normally do so by simple removal of the pressure applied to bore 22. The outer sleeve 88 eventually catches a shoulder 144 on the piston assembly 79 so that the entire piston assembly and the apparatus can be removed from the wellbore with the cage 108 positioned as shown in FIG. 5.

Those skilled in the art will appreciate that the apparatus A of the present invention provides a simple and reliable way to orient the upper section 20 of the apparatus A with respect to the lower segment or lower assembly 18, which includes the linkage comprising links 50 and 54. Since housings such as housing 14 are typically manufactured with locating grooves 76 placed at a predetermined distance from the portion of the housing 14 that includes the sleeve 10, being able to reliably engage such a groove, in combination with an apparatus of a predetermined length from the dogs 112 to the linkage comprising links 50 and 54, will reliably allow for proper orientation and anchoring of the apparatus A before the power stroke occurs. The apparatus A is clearly resettable so that it can regrip the sleeve 10 numerous times for further urging in the same direction as the previous effort. The gripping assembly, which comprises the linkage made up of links 50 and 54, also can be held in the retracted position for proper placement. The linkage is flexible to grab sleeves 10 of different diameters in the same run and further provides the feedback feature to allow the operator at the surface to know whether the sleeve has been fully shifted. The apparatus can be passed through one or more sleeves until the desired one is reached by keeping links 50 and 54 retracted until the proper sleeve is reached. The unique shape of link 54 allows protrusion 72 to enter nearly squarely into grooves 12 of varying depths, giving the apparatus additional flexibility to handle sleeves or other downhole components of various sizes. Feedback on the position of sleeve 10 is provided by virtue of the success or failure of link 54 in reengaging groove 12. Without removal for re-dressing, the apparatus can be reused for another attempt to move the sleeve 10, if desired. Thus, in coiled tubing applications where it may be problematic, especially in a deviated wellbore, to put a significant downhole force on a shifting tool, the apparatus of the present invention solves the problems of the prior art by providing a simple tool that is easily orientable for repeated attempts, if necessary, to move a sleeve 10 to a desired position. Those skilled in the art will appreciate that the hydraulically actuated piston assembly, in combination with the locating feature, can be used to operate a wide variety of downhole tools different from sleeve shifting tools, all without departing from the spirit of the invention.

The foregoing disclosure and description of the invention are illustrative and explanatory thereof, and various changes in the size, shape and materials, as well as in the details of the illustrated construction, may be made without departing from the spirit of the invention.

We claim:

1. An apparatus for actuating a downhole component which has a movable member and, apart from said movable member, an indexing feature for support of the apparatus thereon, comprising:

a body;

a gripping assembly mounted to said body, selectively engageable to the movable member for actuation thereof;

a position-locking assembly on said body selectively engageable to the indexing feature of the movable member;

at least one piston supported by said body and operably connected to said gripping assembly for moving said gripping assembly while said body is selectively locked to the indexing feature of the movable member.

2. The apparatus of claim 1, wherein:

said gripping assembly is retained in a retracted position where it cannot engage the movable member until a predetermined force is applied through said body.

3. The apparatus of claim 1, wherein:

said gripping assembly, when released to engage the movable member, supports said piston, whereupon a further application of force through said body to said piston longitudinally repositions said locking assembly to align said locking assembly with the indexing feature.

4. The apparatus of claim 3, wherein:

said position-locking assembly further comprises at least one locking dog initially biased into a retracted position where it cannot engage the indexing feature; and a cam to selectively cam said dog into the indexing feature upon alignment of said dog with the indexing feature.

5. The apparatus of claim 4, wherein:

said cam is movably mounted with respect to said body, whereupon application of said force through said body, said dog displaces said cam until said dog aligns with the indexing feature, whereupon said cam moves with respect to said dog to force said dog outwardly into the indexing feature and to selectively lock its position therein.

6. The apparatus of claim 2, wherein:

said piston, with said position-locking assembly selectively locked to the indexing feature, moves said gripping assembly while said gripping assembly is engaged to the movable member, said gripping assembly formed to automatically release from the movable member without the possibility of reengagement upon movement of the movable member by a predetermined amount.

7. The apparatus of claim 6, wherein:

said gripping assembly comprises a linkage and a pressure-actuated retaining sleeve, whereupon actuation of said sleeve, responsive to applied fluid pressure, said linkage is biased to an expanded position to engage the movable member while upon removal of said applied fluid pressure, said linkage is biased to said retracted position.

8. The apparatus of claim 7, wherein:

said linkage having a specially shaped link which, by virtue of contact with the downhole component, is cammed out of contact with the movable member upon a predetermined movement of the movable member.

9. The apparatus of claim 5, wherein:

said body further comprises a return biasing member on said piston, whereupon removal of fluid pressure applied to move the piston in a first direction, said return biasing member moves said piston in a second and reverse direction, resulting in displacement of said cam from under said dog, whereupon said dog is biased radially away from the indexing feature.

10. The apparatus of claim 9, wherein:

said body is formed of an upper and lower segments attached by a breakable member, said lower segment houses said dog;

said upper segment movable with respect to said lower segment when said breakable member is broken;

whereupon if an emergency release is required with said dog holding said lower body to the indexing feature, said upper segment can be translated after said breakable member is broken until said cam is forced out from under said dog to release said lower segment.

11. The apparatus of claim 10, wherein:

said upper segment engages said piston as it is pulled after said breakable member is broken, whereupon said piston contacts said cam to displace it from under said dog, whereupon said lower segment translates with respect to said piston until said dog can be further radially retracted, whereupon said lower segment of said body is then removable with said piston and said upper segment of said upper body.

12. The apparatus of claim 1, wherein:

said piston, with said position-locking assembly selectively locked to the indexing feature, moves said gripping assembly while said gripping assembly is engaged to the movable member, said gripping assembly formed to automatically release from the movable member without the possibility of reengagement upon movement of the movable member by a predetermined amount.

13. A sleeve-shifting apparatus for shifting a sleeve in a tubular having an indexing groove on the tubular, comprising:

a body;

a gripping member on said body selectively engageable to the sleeve;

a piston operably on said body connected to said gripping member to accomplish its movement;

a locking assembly on said body to selectively fix its position with respect to the indexing groove to allow stroking said piston to in turn actuate said gripping member.

14. The apparatus of claim 13, wherein:

said gripping member is retained in an initial retracted position until, responsive to applied fluid pressure to a first level, it is liberated to move into engagement with said sleeve;

whereupon increase of said applied pressure beyond said first level to a second level, said body moves with respect to said piston and said gripping member, which are supported on the sleeve, to longitudinally position said locking assembly by said indexing groove.

15. The apparatus of claim 14, wherein:

said gripping member further comprises at least one locking dog movably mounted to said piston;

said body, when moving with respect to said piston, pushing said dog on said cam to advance said dog toward said indexing groove.

16. The apparatus of claim 15, wherein:

said dog is biased toward said piston while extending into a window on said body;

said dog deflecting said cam until said dog aligns with the indexing groove, whereupon said cam is biased under said dog, forcing it radially out said window and into a locking engagement with said indexing groove.

17. The apparatus of claim 16, further comprising:

a biasing element on said body acting on said piston, whereupon removal of applied fluid pressure to said piston said biasing element moves said piston with respect to said body, removing said cam from under said dog to facilitate release from the tubular.

18. The apparatus of claim 13, wherein said gripping member further comprises:

a pivoting linkage comprising a specially shaped gripping link having an extending segment to engage a recess in the sleeve and a camming segment to engage the tubular to cam said gripping link out of the recess in the sleeve once the sleeve has been shifted a predetermined distance, whereupon feedback to the surface of the movement of the sleeve is provided which depends on whether said gripping link can or cannot reengage the recess in the sleeve.

19. The tool of claim 18, wherein:

said pivoting link has its said extending segment oriented in such a manner so that pivoting of said gripping link allows said extending segment to enter the recess on sleeves of more than one size.

20. A method of shifting a sleeve mounted to a tubular member in a wellbore, comprising the steps of:

lowering a tool adjacent the sleeve to be shifted;

selectively engaging a recess in the sleeve with a gripping member;

orienting a locking member with a groove on the tubular;

securing the tool to the groove on the tubular;

stroking a piston connected to the gripping member to shift the sleeve.

21. The method of claim 20, further comprising the step of:

moving said tool by applying pressure on said piston while said piston is supported by the engagement of said gripping member into said recess in the sleeve.

22. The method of claim 21, further comprising the steps of:

camming said locking member into said groove upon sufficient movement of said tool;

locking the position of the locking member into said groove resulting from said camming.

23. The method of claim 22, further comprising the steps of:

relieving applied pressure to said piston;

forcing said piston to reverse its motion;

undermining support for the locking member by forcing a cam out from under a locking dog which had extended into the indexing groove on the tubular;

releasing the tool from the tubular.

24. The method of claim 23, further comprising the steps of:

initially retaining said gripping member in a retracted position with a pressure-actuated sleeve;

releasing said gripping member by application of fluid pressure to said sleeve;

automatically releasing said gripping member from the recess in the sleeve once the sleeve shifts a predetermined distance;

attempting to reengage the recess in the sleeve after said stroking of said piston;

obtaining feedback as to whether the sleeve has fully shifted, depending on whether reengagement of said gripping member with the recess in the sleeve is accomplished.

25. The method of claim 20, further comprising the steps of:

automatically releasing said, gripping member from the recess in the sleeve once the sleeve shifts a predetermined distance;

attempting to reengage the recess in the sleeve after said stroking of said piston;

obtaining feedback as to whether the sleeve has fully shifted, depending on whether reengagement of said gripping member with the recess in the sleeve is accomplished.

* * * * *